United States Patent [19]

Platt

[11] Patent Number: 4,827,681

[45] Date of Patent: May 9, 1989

[54] INTERLOCKING CROSS TEE

[75] Inventor: William J. Platt, Collingdale, Pa.

[73] Assignee: National Rolling Mills, Inc., Malvern, Pa.

[21] Appl. No.: 93,853

[22] Filed: Sep. 8, 1987

Related U.S. Application Data

[63] Continuation-in-part of Ser. No. 935,762, Nov. 28, 1986, Pat. No. 4,785,603.

[51] Int. Cl.[4] ..... F16B 7/22; E04C 2/42

[52] U.S. Cl. ..... 52/98; 52/232; 52/667; 52/484

[58] Field of Search ..... 52/484, 667, 98, 232

[56] References Cited

U.S. PATENT DOCUMENTS

| | | | |
|---|---|---|---|
| Re. 31,201 | 4/1983 | Sauer | 52/667 |
| 3,239,035 | 3/1966 | Znamirowski | 52/667 |
| 3,283,467 | 11/1966 | Znamirowski | 52/667 |
| 3,367,695 | 2/1968 | Haertel et al. | 52/484 X |
| 3,378,976 | 4/1968 | Meredith, Jr. | 52/484 X |
| 3,396,997 | 8/1968 | Adams | 52/484 |
| 3,496,690 | 2/1970 | Jahn | 52/232 |
| 3,746,379 | 7/1973 | Sauer | 287/189.36 A |
| 3,778,947 | 12/1973 | Sauer | 52/232 |
| 3,846,031 | 11/1974 | Adams | 403/28 |
| 3,979,874 | 9/1976 | Cubbler, Jr. et al. | 52/484 X |
| 4,108,563 | 8/1978 | Brown et al. | 403/347 |
| 4,208,851 | 6/1980 | Sauer | 52/573 |
| 4,462,198 | 7/1984 | Sharp | 52/667 |
| 4,525,973 | 7/1985 | Vukmanic et al. | 52/667 |
| 4,648,230 | 3/1987 | Mieyal et al. | 52/484 X |
| 4,685,262 | 8/1987 | Meredith, Jr. | 52/484 X |

*Primary Examiner*—David A. Scherbel
*Assistant Examiner*—Lan Mai
*Attorney, Agent, or Firm*—Eugene Chovanes

[57] ABSTRACT

A fire-resistant suspended ceiling grid structure having cross tees and main beams, to support ceiling tiles. The structure has shear means to permit a cross tee to expand into a main beam during a fire. The shear means have a notch behind a transverse tab formed in the cross tee which acts as a stop against the main beam in normal conditions, and shears or bends during a fire to permit the cross tee to expand into the main beam and still hold the tile in place.

1 Claim, 5 Drawing Sheets

FIG. 6
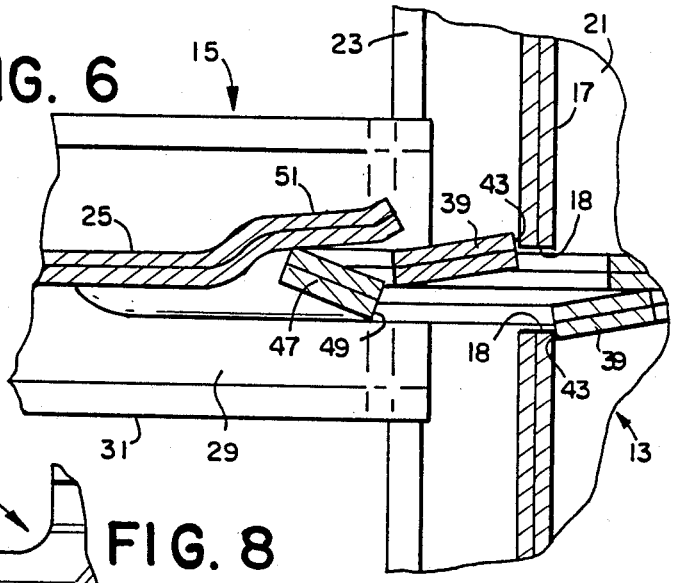
FIG. 8
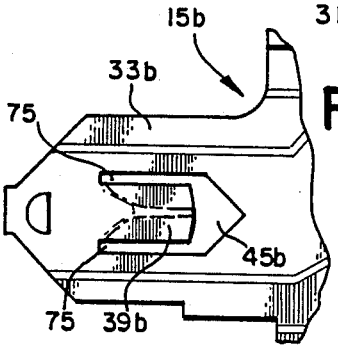
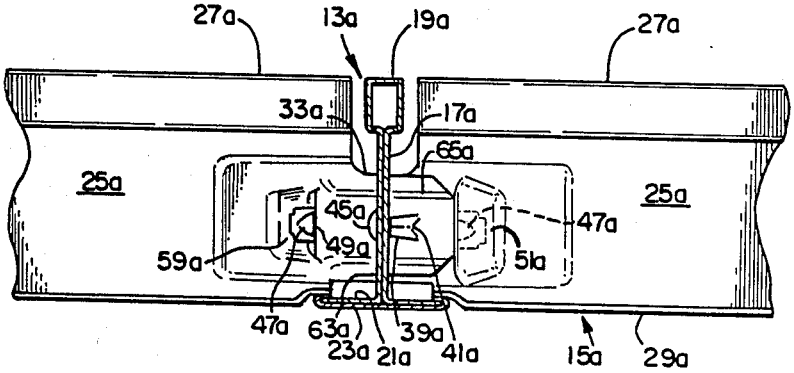
FIG. 7

INTERLOCKING CROSS TEE

This is a continuation-in-part of application Ser. No. 935,762 filed Nov. 28, 1986, now Pat. No. 4,785,603, for Interlocking Cross Tee.

BACKGROUND OF THE INVENTION

1. Field of the Invention

This invention relates to improvements in a suspended ceiling grid structure adapted to support ceiling tiles or the like, and more particularly concerns improvements in such structures in connecting means between elements of the grid structure.

The claims of application Ser. No. 935,762 relate to a seismic-resistant ceiling. The invention claimed herein relates to a fire-resistant ceiling.

2. Description of the Prior Art

Seismic-resistant as well as fire-resistant suspended ceiling gride structures for supporting ceiling tiles are known in the art. Typically, such grid structures have a plurality of parallel main beams or runners connected together at right angles by a plurality of cross tees. The main beams and cross tees are made of metal that is generally thin, so that even when the main beams and cross tees are constructed with a double thickness of such metal, the connecting means may fail when subjected to high levels of tension, such as the vibrations caused by seismic disturbances. The metal also has an appreciable positive temperature coefficient of expansion and, consequently, the main beams and cross tees tend to expand from the heat generated by the fires, causing the grid structure to twist and bend and drop the ceiling tiles.

Various efforts have been made in the prior art for modifying suspended ceiling grid connections means for accommodating the stress of contraction and expansion so as to maintain the proper support of ceiling boards even during a condition of excessive vibration as would be caused by a seismic disturbance or a condition of excessive heat as would be caused by a fire. The prior art proposals to accommodate, and hence, avoid the adverse effects of undue stress in the connecting means of a cross tee grid structure have involved the use of locking tabs to lock a cross tee to a main beam after the cross tee has been inserted through a slot in the main tee. In addition, the cross tees of such a structure have been made to interlock to increase the resistance of such cross tees to forces tending to pull them apart. However, such connecting means in some instances required the use of clips to lock the connecting means together, or a separate end connector made of higher strength steel shaped to the end of the web.

The use of reinforcing clips to lock the connection between cross tees and main beams of a suspended ceiling structure adds undesirably both to inventory and installation problems as well as to cost of materials. The use of these clips in some instances has been necessary, however, because interlocking cross tees and locking tabs of cross tees known in the art have not been strong enough to withstand high compression and tension forces.

Another problem has been how to provide interlocking cross tees with a means for easy disengagement from the interlocket position for removal of such cross tees without damage.

SUMMARY OF THE INVENTION

There is formed at the end of a cross tee in a ceiling grid system a tongue intended to pass through a slot in a main runner and lock to the main runner. The cross tee can stay fixed to the main runner alone, as in an area of the ceiling close to a wall, or as is generally the case, can interlock with the tongue on another cross tee which is inserted through the slot on the main runner from the opposite side thereof. The tongue on one end of the cross tee enters a pocket on the end of the adjacent cross tee. Various stops provide for positive locking. The invention provides a strong connection to prevent separation in the event of seismic disturbances. By providing a shear tab, the invention yields a fire-rated ceiling which permits staged expansion so that the ceiling can remain sufficiently intact during a fire to keep the ceiling tile in place. The tile, or boards, provide a fire-retardant, or containment effect.

Accordingly, among the objects of the invention is the provision of an improved ceiling grid system including main beam and cross tee connecting means that is operative to acommodate the stress of the forces caused by excessive vibrations from a seismic disturbance, or the stress of the expansion forces caused by heat during a fire, in a manner that does not detract from the rigidity of the grid structure and its capacity to support the ceiling boards without sagging.

A further object of the invention is to provide a fire-resistant ceiling capable of staged expansions at the opposite ends of the cross tees whereby a controlled expansion takes place at one end of a cross tee before controlled expansion takes place at the opposite end of the tee.

A further purpose is to control the expansion of a cross tee during a fire without having the ceiling collapse.

A further purpose is to provide shear tabs in a suspended ceiling construction to permit controlled longitudinal expansion of cross members so that the metallic cross tees and main runners can continue to support the ceiling tiles during a fire, thus utilizing the fire-resistant qualities of the ceiling construction during the fire.

A further purpose is to limit expansion, after the tabs are sheared, by using a pocket to form a barrier.

Further purposes appear in the specifications and drawings.

BRIEF DESCRIPTION OF THE DRAWINGS

FIGS. 1 through 8 show the grid structure claimed in my copending application, Ser. No. 935,762, dealing with a semi-resistant ceiling.

FIG. 1 is a fragmentary view in perspective of a suspended ceiling grid structure constructed in accordance with the invention;

FIG. 2 is a view in section as indicated by the lines and arrows 2—2 which appear in FIG. 1;

FIG. 3 is a view in section as indicated by the lines and arrows 3—3 which appear in FIG. 1;

FIG. 4 is a view in section as indicated by the lines and arrows 4—4 which appear in FIG. 3;

FIG. 5 is a fragmentary view in perspective of two oppositely disposed interlocking cross tees and a main beam before the cross tees are inserted into the main beam;

FIG. 6 is an enlarged view of a portion of the connecting means shown in FIG. 4;

FIG. 7 is a view partly in section of another embodiment of the invention;

FIG. 8 is a detail view of an alternative embodiment of the connecting tongue of the invention.

FIG. 9 is a view similar to FIG. 5, showing in perspective two oppositely disposed interlocking cross tees and a main beam before the cross tees are inserted into the main beam.

FIG. 10 shows the connection assembled, similar to the view of FIG. 3.

DETAILED DESCRIPTION

Figure 1:
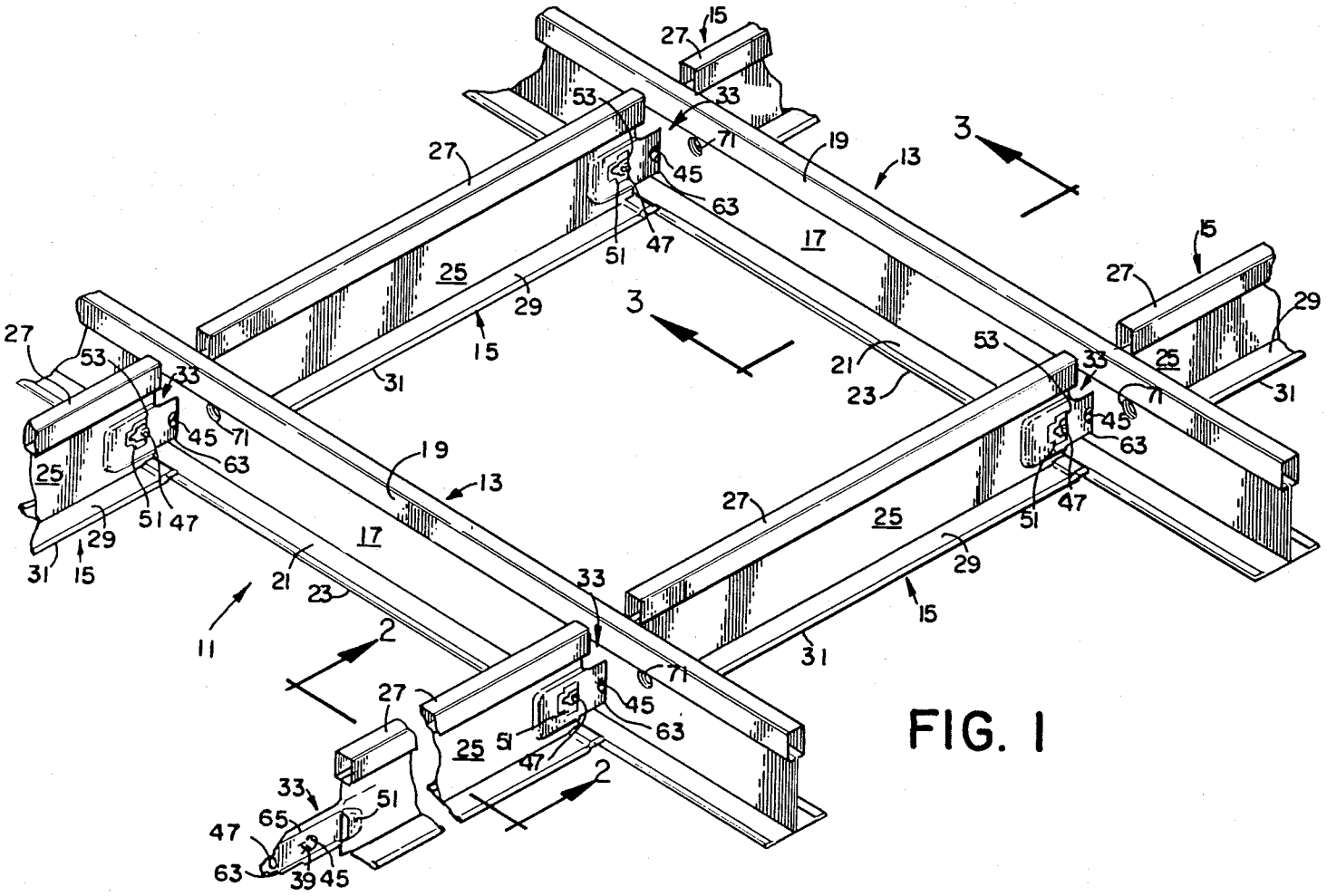
Figure 2:
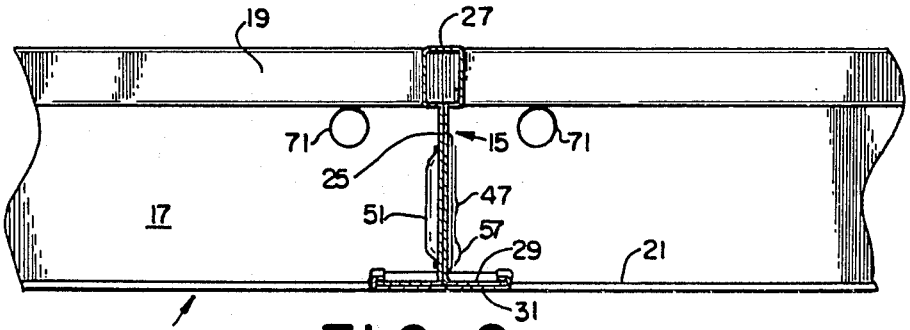
Figure 3:
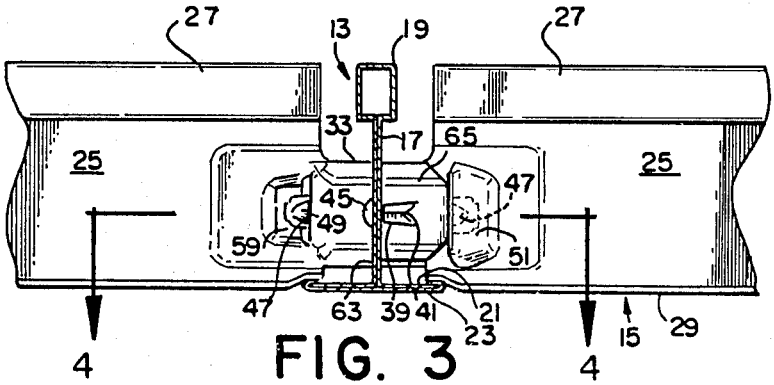
Figure 4:
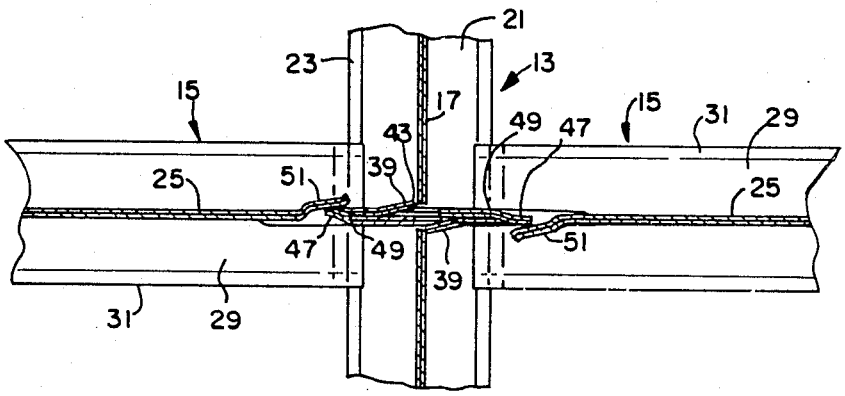
Figure 5:
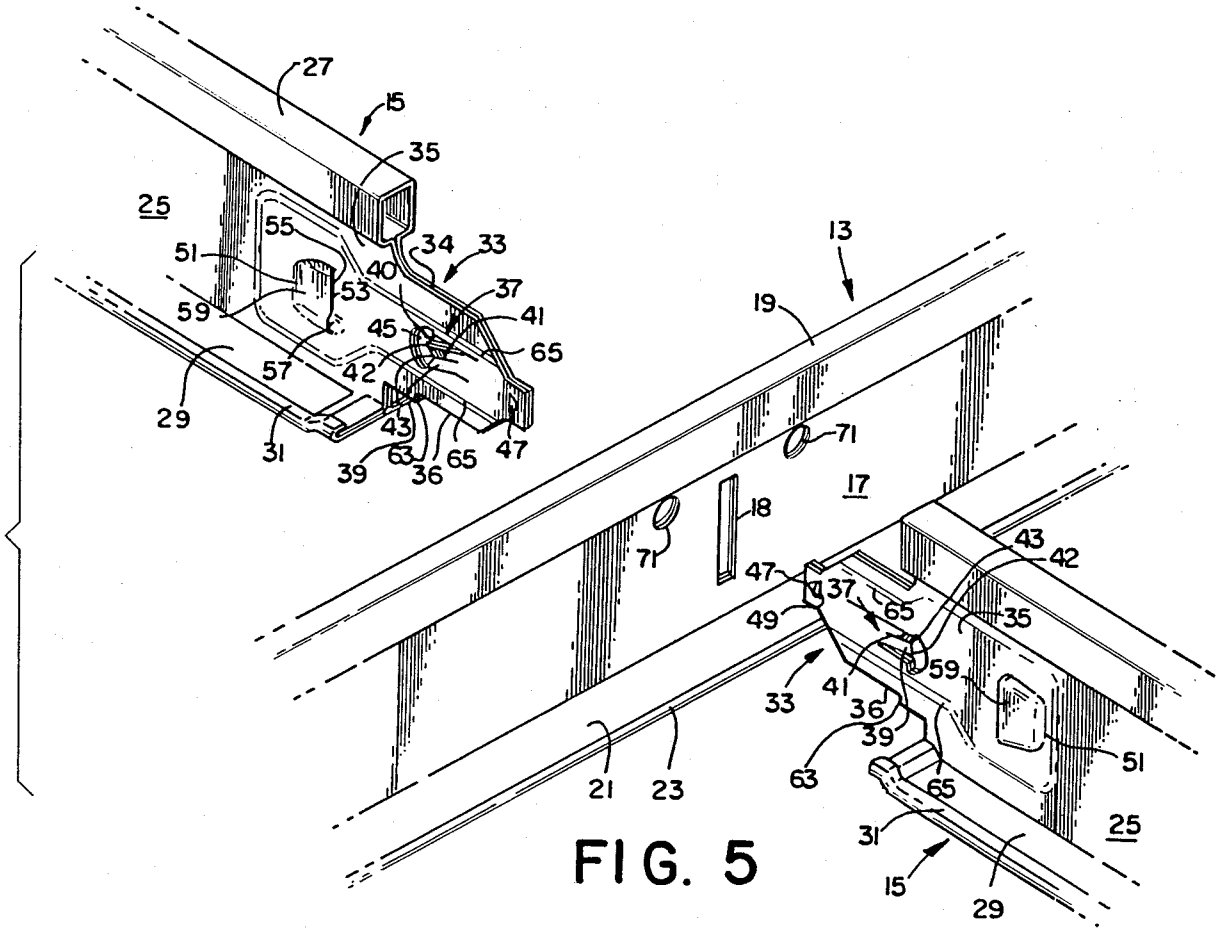

FIGS. 1 through 8.

In FIGS. 1 through 8, there is shown the invention as directed to a seismic-resistant ceiling. A suspended ceiling grid structure 11 supports ceiling tiles or the like. The structure 11 comprises a plurality of main beams or runners 13 arranged in spaced-apart, substantially parallel relationship, and cross tees 15 which connect adjacent main beams 13 together.

Each main beam 13 has a inverted T shape, and includes a central fin or web 17 having a reinforced bead or bulb 19 at the top and a pair of oppositely disposed flanges 21 at the bottom. An ornamental cap 23 is mounted on the bottom of flanges 21.

Cross tees 15 are also of inverted T construction and each includes a central fin or web 25, a reinforcing bead or bulb 27 at the top of central web 25, an ornamental cap 31 mounted on the bottom of flanges 29, and a connnecting tongue 33 extending from each end 35 of a web 25. The tongue 33 is preferably offset from the center plane of the web 25 by approximately one-half thickness of the web 25.

On each tongue 33 of the cross tees 15 is provided a locking means 37, of such configuration that either end of a cross tee 15 may be locked to a slot 18 provided in a main beam 13 to which a cross tee 15 is connected in the suspended ceiling grid structure 11. The locking means 37 on each tongue 33 comprises a locking tab 39 and an opening 45. The locking tab 39 is formed in the tongue 33 and extends laterally outwardly from the tongue 33 to create a locking tab edge 43 whereby when a cross tee 15 is locked to a main beam 13 the locking tab edge 43 of the tongue 33 engages the central web 17 of the main beam 13. A tab spine or crease 41 is formed in the center of locking tab 39 so that the locking tab 39 is V-shaped in cross section, with the locking tab edges 42 extending away from, and the tab spine 41 being close to, the tongue 33. The V-shape in cross section of the locking tab 39 greatly increases the resistance of the cross tee 15 to pull-apart forces.

The opening 45 is formed axially away from the locking tab edge 43 of the locking tab 39 whereby when a tongue 33 is inserted through a slot 18 of a main beam 13, the locking tab 39 flexes back into the cavity 40 it left when the locking tab 39 was punched, and flexes into the opening 45. The opening 45, which is preferably D-shaped, is provided because when a tab 39 is punched through sheet metal, it is larger than the cavity it leaves. If the opening 45 were not present, the locking tab 39 could not flex back when inserted through the slot 18 of the main beam 13, because edge 43 would strike the metal of the web 25.

Each cross tee 15 further includes interlocking means of such configuration that either end of a cross tee 15 may be interlocked with a similarly constructed but oppositely disposed cross tee 15. The interlocking means comprises an interlocking fingernail 47 formed in and extending laterally outwardly from the tongue 33 and in a direction opposite to the projection of locking tab 39. The interlocking fingernail 47 is preferably formed by depressing the metal and making only a vertical cut or incision in the tongue 33 whereby an interlocking fingernail edge 49 is produced.

The interlocking means further includes a fingernail interlocking pocket 51 formed in and extending laterally outwardly from the central web 25 of the cross tee 15. The fingernail interlocking pocket 51 is preferably formed by depressing the metal and making only a vertical cut or incision on the central web 25 of the cross tee 15, which creates a fingernail interlocking pocket edge 53 that has a top portion 55 and a bottom portion 57 for engaging the interlocking fingernail edge 49 of a connecting cross tee 15.

The fingernail interlocking pocket 51 includes an offset or raised portion 59 that extends away from and axially along the central web 25 for a distance to form the pocket, whereby a connecting tongue 33 of an interconnected cross tee 15 is not severely bent or deformed when inserted into the interlocked position.

Another feature of the interlocking means is that the bottom portion 57 of the fingernail interlocking pocket edge 53 is flared laterally outwardly in a direction opposite to the direction of the extension of the fingernail interlocking pocket 51 by an amount approximately the thickness of an interlocking fingernail 47 whereby the tongue 33 of the cross tee 15 and the tongue 33 of a similarly constructed but oppositely disposed cross tee 15 may be disengaged from the interlocked relationship by moving the interlocked cross tees 15, 15 so that an interlocking fingernail 47 of one cross tee 15 passes through the interlock release pocket 57 of the opposite cross tee 15.

Each cross tee 15 additionally includes a tee stop shoulder or notch 63 formed in the bottom edge 36 of tongue 33 for abutting the central web 17 of the main beam 13 when the cross tee 15 is inserted through the slot 18 in the central web 17.

The cross tees 15 are also provided with stiffening ribs 65 that reinforce and greatly strengthen the ends of cross tees 15 and connecting tongues 33.

In the embodiment of the invention shown in FIG. 7, the reinforcing bulb or bead **27*a* of each cross tee 15*a* extends radially to a position whereby when cross tees 15*a* are connected to a main beam 15*a*, the bulbs 27*a* of the cross tees 15*a* more nearly abut the bulb 19*a* of the main beam 13*a***.

FIG. 18 shows another embodiment of the invention where two slits 75 are formed in the tongue **33*b* of the cross tee 15*b*. The slits 75 are formed above and below the locking tab 39*b* and provide additional clearance so that the sides of the locking tab 39*b* do not strike the metal of the tongue 33*b* when the locking tab 39*b* flexes back into the cavity 40*b* as the cross tee 15*b* is inserted through the slot 18 of the main beam 13. The opening 45*b* of this embodiment is triangle-shaped, and is contiguous with the slits 75 so that the opening 45*b* and the slits 75** have a combined U-shaped appearance.

Hanger holes 71 are formed in the central web 17 of main beam 13, and are adapted to receive wire hangers that support the grid structure.

In operation, main beams 13 are suspended from the ceiling by wire hangers attached to hanger holes 71, and cross tees 15 are locked to main beams 13 by sliding the connecting tongues 33 through slots 18 so that the locking tab edges 43 and tee stop shoulders 63 abut central web 17 of main beam 13. Additionally, the connecting tongues 33 slide into the fingernail locking pocket 51 of oppositely disposed cross tees 15 far enough so that the edge 49 of the interlocking fingernail 47 slides over and then abuts or engages the edge 53 of the fingernail interlocking pocket 51.

When the suspended ceiling grid structure 11 is subjected to severe tension as caused by the excessive vibrations of a seismic disturbance, the locking tab 39 of a cross tee 15 exerts pressure against the central web 17 of the main beam 13. Also, the interlocking fingernail edge 49 of a cross tee 15 exerts pressure against the fingernail interlocking pocket edge 53 of a similarly constructed but oppositely disposed interlocked cross tee 15. Further, interlocking fingernail 47 of a cross tee 15 exerts pressure against the raised portion 59 of the fingernail interlocking pocket 51 of a similarly disposed interlocked cross tee 15.

Figure 10:
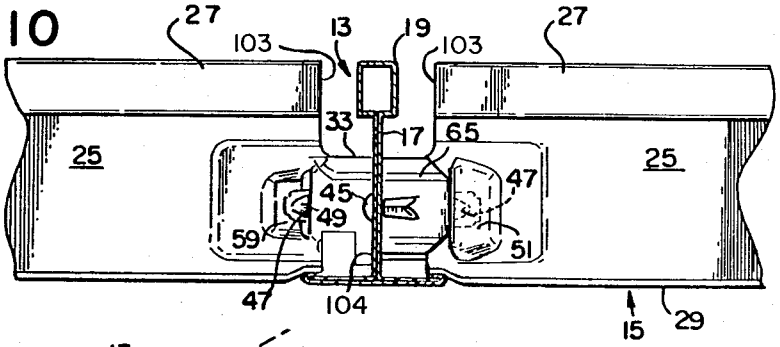
FIGS. 9 and 10 show the rigid structure claimed herein, which deals with a fire-resistant ceiling.
Figure 9:
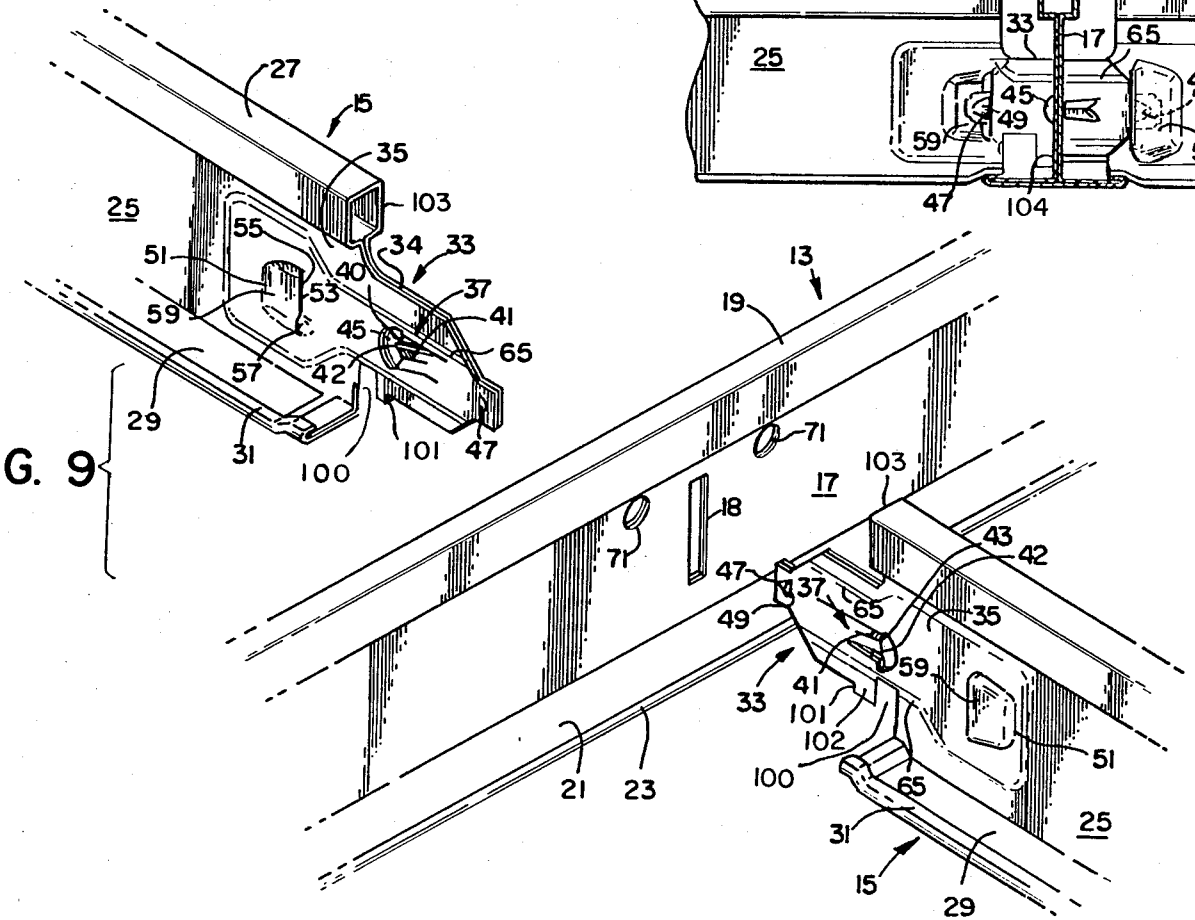

FIGS. 9 and 10.

In FIGS. 9 and 10, I show the invention as directed to a fire-resistant ceiling. The connection is essentially the same as that showing FIGS. 1 through 8, except a notch 100 exists behind shoulder 101, whereby a shear tab 102 is formed.

Additionally, the web 25 can be recessed to a greater depth at 103.

In the event of a fire, cross tee 15 expands longitudinally, whereby shear tab 102 is forced against the web of the main runner at 104. The cross tee continues to expand, shearing off tab 102 as the tongue 33 is forced deeper into pocket 51.

The tongue 33 will be received in pocket 51 and seated therein, whereby further expansion will be resisted.

As further expansion of the cross tee continues from the heat of the fire, the tab 102 at the opposite end of the cross tee 15 will bend, or shear, permitting tongue 33 to pass through slot 18 until tongue 33 is restrained by pocket 51.

Such controlled, staged expansion permits the expansion to take place in, for instance, increments of $\frac{1}{8}$ to $\frac{1}{4}$ inches.

In the event further expansion of the cross tee 15 continues, pocket 51 will yield, particularly where the metal has desirably been suitably weakened in fabrication, as by slitting. The ceiling continues to be generally intact, even after the pocket yields, since a still further stop occurs when web 25 abuts the main runner at point 103.

Thus, a controlled, staged expansion of the ceiling grid system occurs, which continuously supports the tile or boards, thus providing a fire-resistant barrier during a fire.

The tab is such that it shears or breaks under a 35 lb. force in a cold condition, and the pocket parts at a force of 55 lb. in a cold condition. In an actual fire, the forces would vary depending on the heat of the metal.

ADVANTAGES

The suspended ceiling grid structure 11 of the invention is provided with increased strength at the interconnection or coupling between a main beam 13 and a cross tee 15, such increased strength being obtained without the use of heavier gauge metal for the webs 17 of the main beam 13 or the use of clips to lock a cross tee 15 to a main beam 13. This improvement in strength is obtained from the interlock between fingernail 47 and interlocking pocket 51.

There is also provided an improved cross tee 15 featuring an opening 45 on a tongue 33 to allow the locking tab 39 to flex back when the cross tee 15 is inserted into the slot 18 of a main beam 13. If this spring 45 is not punched out behind the locking tab 39, the locking tab 39 would not be able to flex back because when a tab is punched through sheet metal, the size of the tab is larger than the size of the opening created by the punch.

There is also provided an improved cross tee 15 featuring an interlocking fingernail 47 and a fingernail interlocking pocket 51. When two similarly constructed but oppositely disposed cross tee 15 are interlocked, the resistance of the interlocked cross tees 15 to pull-apart forces is greatly increased. Additionally, an interlock release pocket 57 is provided in the bottom portion of the fingernail interlocking pocket edge 53. The interlock release pocket 57 allows two similarly constructed but oppositely disposed cross tees 15 to become easily disengaged from the interlocked position without any damage to either cross tee 15.

The fire-resistant ceiling structure of FIGS. 9 and 10, in addition to the above advantages, permits a controlled expansion of the cross tees whereby the metallic support structure can remain generally intact to hold the tile or boards in place. Such expansion occurs when the shear tabs are bent or sheared whereby the cross tee can expand through the slot in the main runner. The main runner is suitably modified to provide for its own expansion as by relief notches or the like, in the known prior art manner.

I claim:

1. In a suspended ceiling grid structure, a cross tee (15) having an inverted T cross section comprising an elongated central web (25) with a bulb (27) at the top and with a pair of oppositely disposed flanges (29) extending outwardly from the bottom of the web (25) and adapted to support ceiling tiles, a connecting tongue (33) extending from an end of the web (25), the tongue (33) being offset from the center of the web by approximately one-half the thickness of the web (25)

locking means (37) formed in the tongue (33) for locking said cross tee (15) to a slot (18) provided in a main beam (13) to which the cross tee (15) is connected in the ceiling grid, an interlocking means (47, 51) formed in the tongue (33) for interlocking the cross tee (15) with interlocking means of a similarly constructed but oppositely disposed cross tee (15) when the cross tees (15) are inserted into the slot (18) from opposite directions, and an interlock release means (57) for disengaging the tongues (33) of two similarly constructed but oppositely disposed interlocked cross tees (15) from the interlocked relationship, the improvement comprising shear means (101, 102) on the elongated central web (25) that stops the cross tee (15) from further entering the slot (18) at normal room temperatures, and shears or bends during a fire, comprising (1) a tab portion (102) extending transversely of the tongue (33), and (2) a notch portion (101) adjacent the tab portion (102) on the side away from the end of the tongue (33) whereby, the cross tee (15) is permitted to expand during a fire, wherein the tab portion (102) shears or bends into the notch portion (101).

* * * * *